United States Patent [19]

Trotta

[11] 4,407,067

[45] Oct. 4, 1983

[54] SHAVING IMPLEMENT

[75] Inventor: Robert A. Trotta, Winthrop, Mass.

[73] Assignee: The Gillette Company, Boston, Mass.

[21] Appl. No.: 298,728

[22] Filed: Sep. 3, 1981

Related U.S. Application Data

[63] Continuation-in-part of Ser. No. 194,551, Oct. 6, 1980, Pat. No. 4,354,312.

[51] Int. Cl.[3] ..... B26B 21/22

[52] U.S. Cl. ..... 30/50; 30/77

[58] Field of Search ..... 30/50, 74.1, 77, 81, 30/74, 47

[56] References Cited

U.S. PATENT DOCUMENTS

| | | | |
|---|---|---|---|
| 2,654,148 | 10/1953 | Robinson | 30/32 |
| 2,807,084 | 9/1957 | Harman | 30/50 |
| 3,488,764 | 1/1970 | Welsh | 30/50 |
| 3,786,563 | 1/1974 | Dorion et al. | 30/50 |
| 3,852,883 | 12/1974 | Ferraro | 30/50 X |
| 3,863,340 | 2/1975 | Perry | 30/50 X |
| 4,069,580 | 1/1978 | Cartwright | 30/47 |
| 4,146,958 | 4/1979 | Chen | 30/50 X |
| 4,272,885 | 6/1981 | Ferraro | 30/47 |
| 4,275,498 | 6/1981 | Ciaffone | 30/47 |

FOREIGN PATENT DOCUMENTS

| | | | |
|---|---|---|---|
| 1593979 | 7/1981 | United Kingdom | 30/50 |

*Primary Examiner*—Jimmy C. Peters

*Attorney, Agent, or Firm*—Scott R. Foster; Raymond J. De Vellis

[57] ABSTRACT

A shaving implement including a platform member, a cap member, and blade means disposed therebetween, the cap member including a series of forwardly extending fingers separated by recesses, the fingers having a first skin-engaging point thereon, and the recesses being defined in part by a cap member wall comprising a second skin-engaging point, the blade means comprising first and second blades each having a blade tangent angle in the range of 20° to 32° and a span in the range of 0.030 tp 0.080 inch, the first blade having an exposure of 0.0015±0.0015 inch, and the second blade having alternating first and second exposures along its length, the first exposure being determined by a first tangent line extending from the first cutting edge to the first skin-engaging point, and the second exposure being determined by a second tangent line extending from the first cutting edge to the second skin-engaging point.

6 Claims, 12 Drawing Figures

SHAVING IMPLEMENT

CROSS-REFERENCE TO RELATED APPLICATION

This is a continuation-in-part of application Ser. No. 194,551, filed Oct. 6, 1980, U.S. Pat. No. 4,354,312 in the name of Robert A. Trotta.

BACKGROUND OF THE INVENTION

1. Field of the Invention

The invention relates to wet shaving implements and is directed more particularly to a wet shaving implement in which there is a plurality of blades.

2. Description of the Prior Art

It is generally known in the art to provide a housing having platform and cap portions adapted to receive a blade means therebetween. In U.S. Pat. No. 1,195,259, issued Aug. 22, 1916 to W. E. O'Reilly, there is shown a platform and cap portion formed from a single piece of metal, the cap overlying the platform.

It is also generally known to embed a blade in a plastic shaving head, the head being permanently attached to a handle, or alternatively, removable from a handle for replacement by another shaving head. U.S. Pat. No. 1,864,995, issued June 28, 1932 to T. H. Frost shows such an arrangement.

More recent examples of plastic shaving heads having blades fixed therein include U.S. Pat. No. 3,703,764, issued Nov. 28, 1972 to Roger L. Perry, U.S. Pat. No. 3,724,070 issued Apr. 3, 1973 to Francis W. Dorion, and U.S. Pat. No. 4,026,016 issued May 31, 1977 to Warren I. Nissen. While such recent examples have been eminently successful, there is, as always, a need for such products which are less expensive to manufacture and offer improved functional characteristics.

U.S. Pat. No. 3,786,563, issued Jan. 22, 1974 to Francis W. Dorion, Jr., et al, discloses geometrical relationships present in plural cutting edge systems. Among the important parameters of plural edge systems are "blade tangent angle", "exposure", and "span".

It has been discovered that a plural cutting edge shaving system in which the above geometrical relationships are maintained within critical limits provides superior shaving characteristics. Such a shaving system includes two cutting edges disposed parallel to one another and in spaced relation to provide leading and following cutting edges so that both cutting edges are successively active with respect to the hair elements being cut during a single shaving stroke. The cutting edges are supported in spaced parallel relation to one another. A guard structure is disposed in fixed relation to the cutting edges to define in part the desired geometrical relationship. Significant components of the geometrial relationship include the above referred to "blade tangent angle," "exposure," and "span."

"Blade tangent angle" is defined as the angle between the bisector of the included angle of a cutting edge and a line from the cutting edge tangent to the skin engaging surface immediately forward of that cutting edge. "Exposure" is defined as the distance from a cutting edge to a plane defined by skin engaging surfaces immediately in front of and behind the cutting edge the distance being measured perpendicularly to the reference plane, the exposure being considered positive when the cutting edge is located on the outer (skin) side of that plane and being considered negative when the cutting edge is further from the skin than that plane. "Span" is defined as the distance between the cutting edge and the skin engaging surface forward of that cutting edge.

SUMMARY OF THE INVENTION

It is a principal object of this invention to provide a novel and improved shaving implement which provides both a close and a safe shave.

A further object of the invention is to provide such a system in which a plurality of cutting edges are fixed in a position with respect to one another and with respect to a cooperating guard structure and cap structure to define a desired geometrical relationship between various components of the system.

A still further object is to provide such a shaving system in which at least one of the parameter-determining surfaces is in effect two surfaces alternating in presentation and therefore presenting alternating geometries.

With the above and other objects in view, as will hereinafter appear, a feature of the present invention is the provision of a shaving implement comprising a platform member, a cap member, and blade means disposed therebetween, said platform member comprising a blade support portion, a guard portion mounted forwardly of said blade support portion, and a back portion upstanding from said blade support portion, said guard and back portions defining parallel opposite lengthwise edges of said platform member, said cap member comprising a series of fingers extending from said back portion forwardly toward said guard portion, said fingers being separated from each other by recesses therebetween, said fingers including a first skin-engaging point and said recesses being defined in part by a cap member wall comprising a second skin-engaging point, and said blade means comprising a first blade member having a first cutting edge disposed rearwardly of said guard portion, a second blade member having a second cutting edge disposed rearwardly of said first cutting edge, and spacer means for maintaining said first and second blade members in spaced parallel relationship, said first and second cutting edges each having a blade tangent angle in the range of 20°–32° and span in the range of 0.03–0.08 inch, said first blade member having an exposure of $0.0015 \pm 0.0015$ inch, and said second blade member having alternating first and second exposures along its length, said first exposure being determined by a first tangent line extending from said first cutting edge to said first skin-engaging point, and said second exposure being determined by a second tangent line extending from said first cutting edge to said second skin-engaging point.

The above and other features of the invention, including various novel details of construction and combinations of parts, will now be more particularly described with reference to the accompanying drawings and pointed out in the claims. It will be understood that the particular device embodying the invention are shown by way of illustration only and not as limitations of the invention. The principles and features of this invention may be employed in various and numerous additional embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
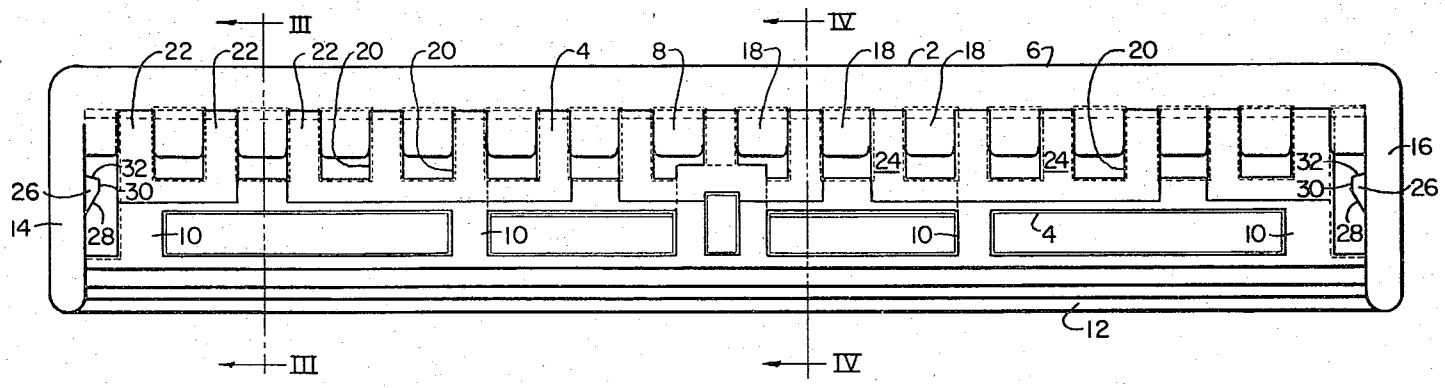
FIG. 1 is a top plan view of a housing suitable for use in a preferred embodiment of the invention.

Referring to the drawings, and particularly FIGS. 1–4, it will be seen that an illustrative housing 2 includes a platform portion 4. A back portion 6 upstands from a lengthwise margin of the platform portion 4, and a cap portion 8 extends forwardly from the back portion 6 to overlie the platform portion. The housing further includes leg portions 10 extending forwardly from the platform portion and joining a guard portion 12 which is disposed parallel to the back portion 6. The housing is further provided with end walls 14, 16 interconnecting the back and guard portions at the ends of the housing.

The cap portion 8 may comprise a series of spaced, aligned, forwardly extending fingers 18. The platform portion may be provided with a series of spaced, aligned recesses 20, the recesses being separated by platform rib portions 22. As may be seen in FIG. 1, each of the fingers 18 is disposed over one of the recesses 20 and each of the rib portions 22 is in alignment with a space between two of the fingers 18.

Preferably, the entire housing is of molded plastic and is molded as an integral unit. The fingers 18 are in effect leaf springs adapted to flex to receive a blade means between the fingers and the platform and further serve to urge the blade means against an upper surface 24 of the platform portion.

Figure 2:
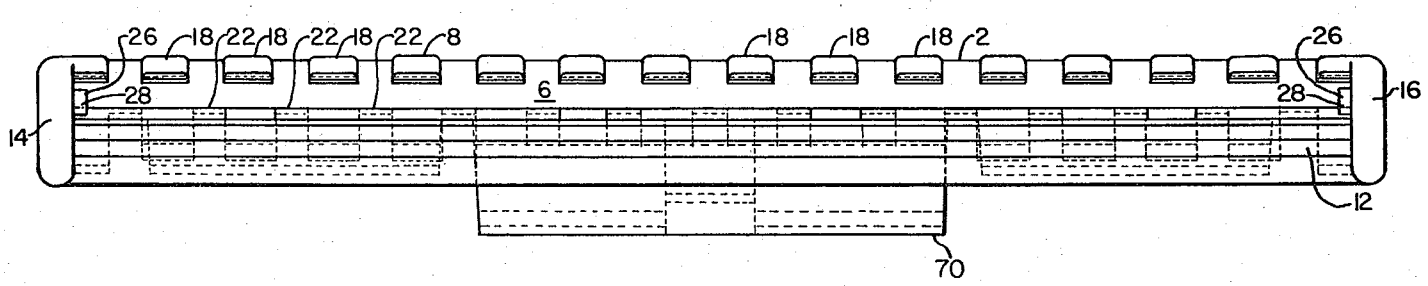
FIG. 2 is a front elevational view thereof.
Figure 4:
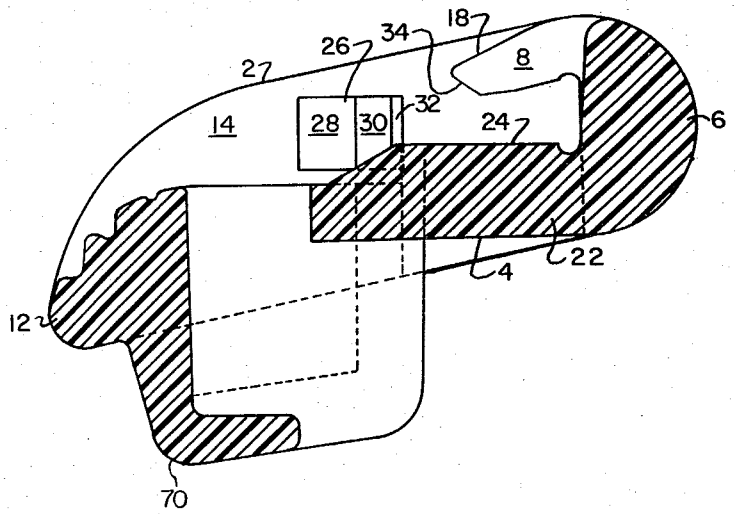
FIG. 4 is a sectional view taken along line IV—IV of FIG. 1.
Figure 3:
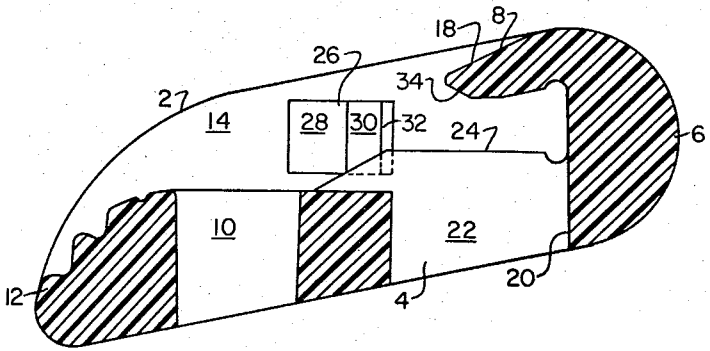
FIG. 3 is a sectional view taken along line III—III of FIG. 1.

In a preferred embodiment, the end walls 14, 16 are provided with inwardly extending projections 26 which are opposed to each other, as seen in FIGS. 1 and 2. The projections provide an additional blade means retention facility. Each projection includes a forward surface 28 extending from the end wall on which the projection is mounted obliquely to a side surface 30. A rear surface 32 interconnects the rearward edge of the side surface and the end wall surface. The function and operation of the projections 26 will be further described hereinbelow.

Each of the fingers 18 include a guide surface 34, serving to guide a blade means into the gap, or pocket, formed by the platform and back portion and the fingers. The fingers 18 are formed such that while extending forwardly, the fingers also extend slightly downwardly, as viewed in FIGS. 3 and 4, or toward the platform surface 24.

Figure 5:
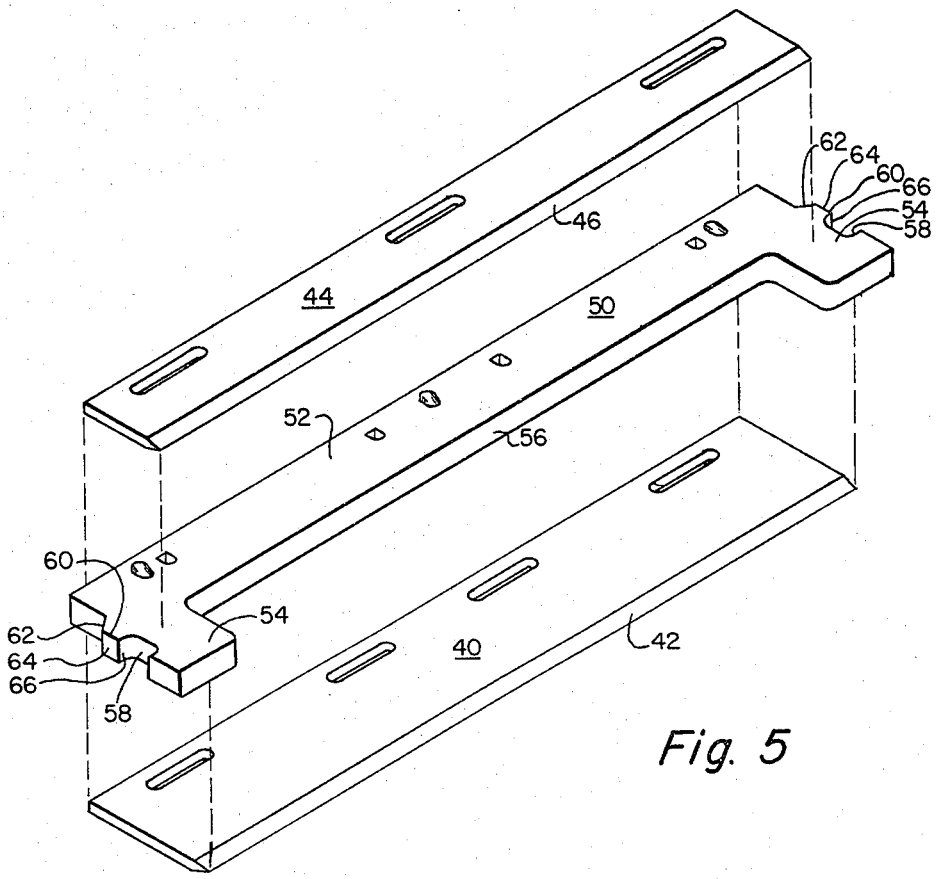
FIG. 5 is an exploded perspective view of an illustrative blade means.

Referring to FIG. 5, it will be seen that a blade means suitable for use with the above-described housing includes a first blade 40 having a cutting edge 42, and a narrower second blade 44 having a cutting edge 46, the blades 40, 44 being disposed on either side of a spacer member 50. The spacer member 50 includes an elongated central portion 52 and end portions 54 extending forwardly of a frontal edge 56 of the central portion 52 and having outwardly-facing notches 58 therein adapted to receive the projections 26. The notches 58 are defined in part by extensions 60, each having a cam surface 62, an outer surface 64, and a notch surface 66.

Figure 6:
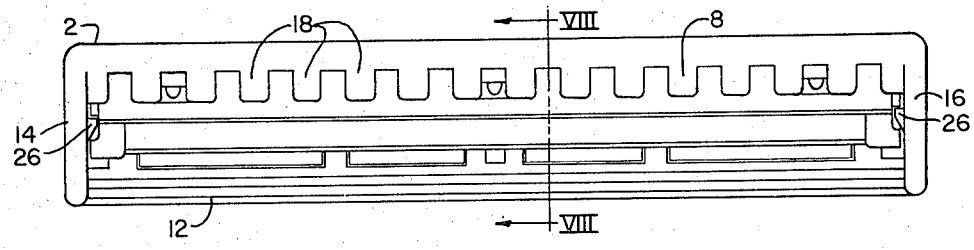
FIG. 6 is a top plan view of one form of shaving implement illustrative of the preferred embodiment of the invention.
Figure 7:
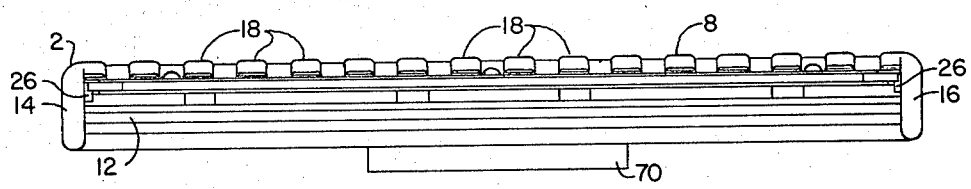
FIG. 7 is a front elevational view of the shaving implement.
Figure 8:
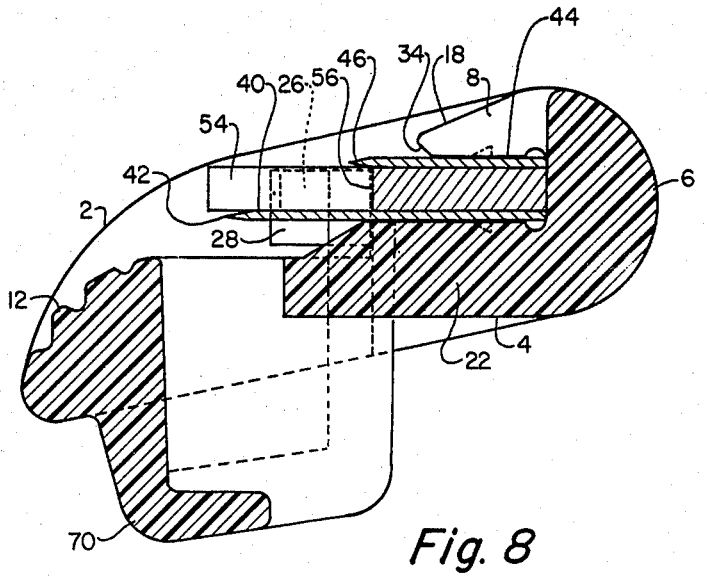
FIG. 8 is a sectional view taken along line VIII—VIII of FIG. 6.

In assembly, the blade means including the first blade 40, spacer 50, and second blade 44, is inserted between the fingers 18 and the upper surfaces 24 of the rib portions 22, the finger guide surfaces 34 guiding and urging the blade means into place. The cam surface 62 engages the projection forward surface 28. Continued pressure on the blade means causes the extensions 60 to override the projections 26, with the notches 58 coming to rest about the projections 26, as seen in FIG. 6.

Figure 9:
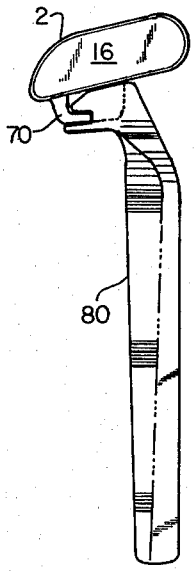
FIG. 9 is a side elevational view of one form of razor illustrative of another embodiment of the invention.

Referring to FIG. 9, it will be seen that the housing may be provided with means for attachment to a razor handle. While such means may comprise the well known groove means disclosed in the aforementioned U.S. Pat. No. 3,724,070, or journal bearing means as disclosed in the aforementioned U.S. Pat. No. 4,026,016, in the embodiment shown in FIGS. 1–4, the housing is provided with connecting means 70 adapted to be engaged by a razor handle 80. The handle 80 may be of the type permanently connected to the housing 2, or may be of the type selectively connected and disconnected to and from the handle. The connecting means 70, or the handle 80, may be molded integrally with the above-described housing.

Figure 10:
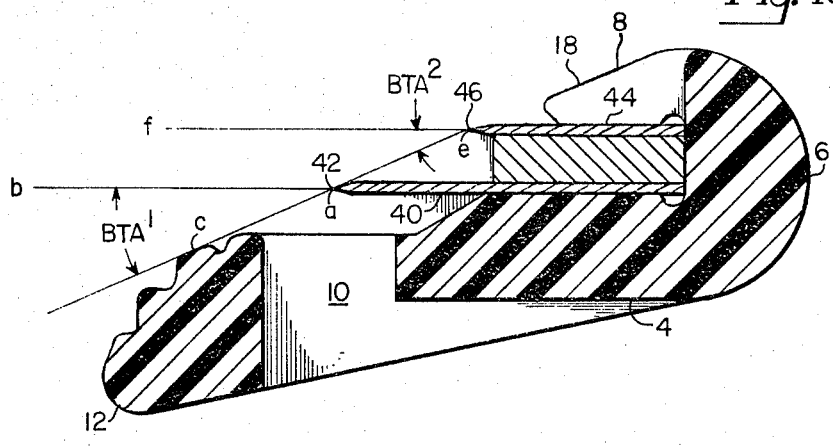
FIGS. 10, 11 and 12 are similar to FIG. 8, but somewhat diagramatic and illustrative of the geometrical parameters pertinent to the invention.

Referring to FIG. 10, there is illustrated the manner in which the blade tangent angle (BTA) is determined. The BTA of the first, or leading, blade, $BTA^1$, is generated by a line a–b bisecting the included angle of the first blade 40 and extending from the first blade cutting edge 42. In the case of blades having symmetrical edges, the line a–b will be an extension of the plane of the first blade. The angle $BTA^1$ is completed by a second line a–c, extending from the first blade cutting edge 42 to a tangent point c on the guard portion 12.

The second, or following, blade tangent angle, $BTA^2$, is defined by a line e–f, similar to the line a–b, and a line e–a extending from the second blade cutting edge 46 to a tangent point immediately preceding the second cutting edge, which in a tandem blade system, is the preceding cutting edge 42.

In the preferred embodiment, $BTA^1$ and $BTA^2$ fall within the range of 20°–32°.

Figure 11:
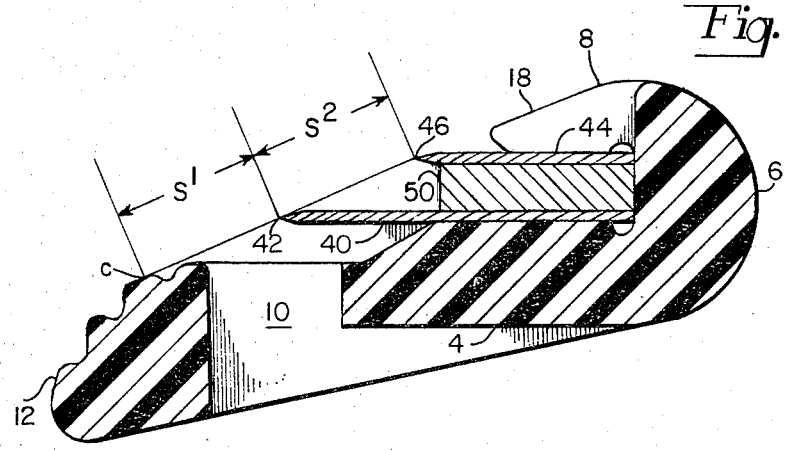

Referring to FIG. 11, there is illustrated the manner in which the span (S) is determined. The S of the first, or leading, blade, $S^1$, is the distance between the first blade cutting edge 42 and the tangent point c of the immediately preceding surface, that is, the guard portion 12.

The second, or following, span, $S^2$, is in the distance between the second blade cutting edge 46 and the tangent point of the immediately preceding surface, namely, the first cutting edge 42.

In the preferred embodiment, $S^1$ and $S^2$ fall within the range of 0.030–0.080 inch.

Figure 12:
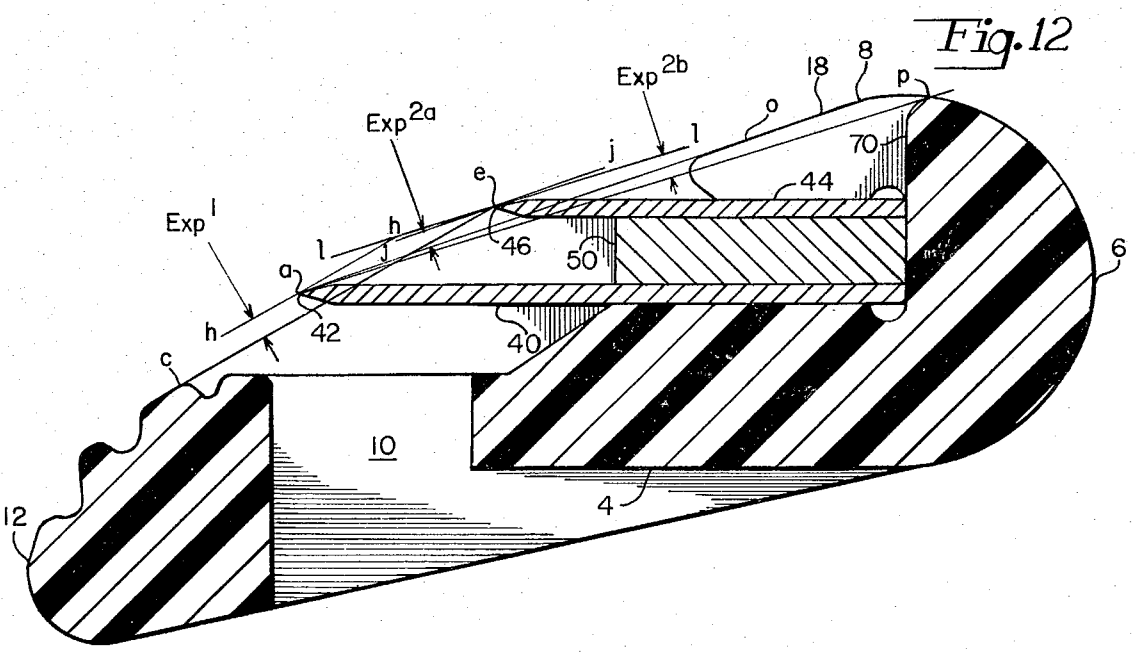

Referring to FIG. 12, there is illustrated the manner in which the exposure (Exp) is determined. The Exp of the first blade, $Exp^1$, is determined by extending a line c–e between the tangent points immediately preceding and following the first cutting edge, that is, from the guard tangent point c to the second blade cutting edge 46. A line h—h is then extended tangent to the first cutting edge 42 and parallel to the line c–e. The perpendicular distance between the lines c–e and h—h defines $Exp^1$. In the preferred embodiment $Exp^1$ falls within the range of 0.0015±0.0015 inch.

The Exp of the second blade, $Exp^2$, alternates along the length of the second blade 44, providing alternating second blade exposures $Exp^{2a}$ and $Exp^{2b}$. To determine $Exp^{2a}$, a line a–o is extended between tangent points immediately preceding and following the second cutting edge 46, namely, the first cutting edge 42 and a first cap tangent point o on the fingers 18. A line j—j is then extended tangent to the second cutting edge 46 and parallel with the line a–o. $Exp^{2a}$ is the perpendicular distance between the lines a–o and j—j.

To determine $Exp^{2b}$, a line a–p is extended between the first cutting edge 42 and a second cap tangent point p disposed in the recesses between the fingers 18 and located at the top of cap member wall 70 of each recess. A line l—l is then extended tangent to the second cutting edge 46 and parallel with the line a–p. $Exp^{2b}$ is the perpendicular distance between the lines a–p and l—l.

In the preferred embodiment $Exp^{2a}$ falls within the range of 0.002±0.002 inch and $Exp^{2b}$ falls within the range 0.004±0.002 inch, $Exp^{2b}$ being always larger than $Exp^{2a}$ in a given device.

For the second exposure $Exp^{2b}$ of the following blade to be meaningful, it is necessary that the fingers 18 be separated by a distance permitting of entry of skin therebetween during a shaving operation. In a preferred embodiment, the distance between the fingers 18 is 0.050 inch, and it is believed that in order to obtain the benefit of the geometry herein described, the fingers 18 ought to be spaced from each other by at least 0.020 inch, but not more than 0.080 inch.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. A shaving implement comprising a platform member, a cap member, and blade means disposed therebetween, said platform member comprising a blade support portion, a guard portion mounted forwardly of said blade support portion, and a back portion upstanding from said blade support portion, said guard and back portions defining parallel opposite lengthwise edges of said platform member, said cap member comprising a series of fingers extending from said back portion forwardly toward said guard portion, said fingers being separated from each other by recesses therebetween, said fingers including a first skin-engaging point and said recesses being defined in part by a cap member wall comprising a second skin-engaging point, and said blade means comprising a first blade member having a first cutting edge disposed rearwardly of said guard portion, a second blade member having a second cutting edge disposed rearwardly of said first cutting edge, and spacer means for maintaining said first and second blade members in spaced parallel relationship, said first and second cutting edges each having a blade tangent angle in the range of 20°–32° and a span in the range of 0.030 to 0.080 inch, said first blade member having an exposure of 0.0015±0.0015 inch, and said second blade member having alternating first and second exposures along its length, said first exposure being determined by a first tangent line extending from said first cutting edge to said first skin-engaging point, and said second exposure being determined by a second tangent line extending from said first cutting edge to said second skin-engaging point.

2. The invention in accordance with claim 1 in which said first exposure is 0.002±0.002 inch and said second exposure is 0.004±0.002 inch.

3. The invention in accordance with claim 2 in which said forwardly extending fingers are spaced apart by at least 0.020 inch and not more than 0.080 inch.

4. The invention in accordance with claim 1 in which said platform member further includes a connector portion for detachably connecting said implement to a razor handle.

5. The invention in accordance with claim 1 in which said platform member further includes a handle portion.

6. The invention in accordance with claims 1, 4 or 5 in which said cap member and said platform member comprise an integrally molded plastic unit adapted to retain said blade means therein.

* * * * *

REEXAMINATION CERTIFICATE (683rd)

United States Patent [19]

Trotta

[11] B1 4,407,067

[45] Certificate Issued May 19, 1987

[54] SHAVING IMPLEMENT

[75] Inventor: Robert A. Trotta, Winthrop, Mass.

[73] Assignee: The Gillette Company, Boston, Mass.

Reexamination Request:
No. 90/001,048, Jul. 2, 1986

Reexamination Certificate for:

| | |
|---|---|
| Patent No.: | **4,407,067** |
| Issued: | **Oct. 4, 1983** |
| Appl. No.: | **298,728** |
| Filed: | **Sep. 3, 1981** |

Related U.S. Application Data

[63] Continuation-in-part of Ser. No. 194,551, Oct. 6, 1980, Pat. No. 4,354,312.

[51] Int. Cl.[4] ..... B26B 21/22
[52] U.S. Cl. ..... 30/50; 30/77
[58] Field of Search ..... 30/47, 50, 74.1, 77, 30/81, 74, 32

[56] References Cited

U.S. PATENT DOCUMENTS

| | | | |
|---|---|---|---|
| 1,226,614 | 5/1917 | Hiskey . | |
| 2,374,612 | 4/1945 | Mellon | 30/70 |
| 2,654,148 | 10/1953 | Robinson | 30/32 |
| 2,780,862 | 2/1957 | Grathwohl | 30/32 |
| 2,807,084 | 9/1957 | Harman | 30/50 |
| 3,488,764 | 1/1970 | Welsh | 30/50 |
| 3,786,563 | 1/1974 | Dorion et al. | 30/50 |
| 4,272,885 | 6/1981 | Ferraro | 30/47 |

FOREIGN PATENT DOCUMENTS

| | | | |
|---|---|---|---|
| 1039546 | 5/1953 | France . | |
| 1593979 | 7/1981 | United Kingdom | 30/50 |

*Primary Examiner*—Douglas D. Watts

[57] ABSTRACT

A shaving implement including a platform member, a cap member, and blade means disposed therebetween, the cap member including a series of forwardly extending fingers separated by recesses, the fingers having a first skin-engaging point thereon, and the recesses being defined in part by a cap member wall comprising a second skin-engaging point, the blade means comprising first and second blades each having a blade tangent angle in the range of 20° to 32° and a span in the range of 0.030 to 0.080 inch, the first blade having an exposure of 0.0015±0.0015 inch, and the second blade having alternating first and second exposures along its length, the first exposure being determined by a first tangent line extending from the first cutting edge to the first skin-engaging point, and the second exposure being determined by a second tangent line extending from the first cutting edge to the second skin-engaging point.

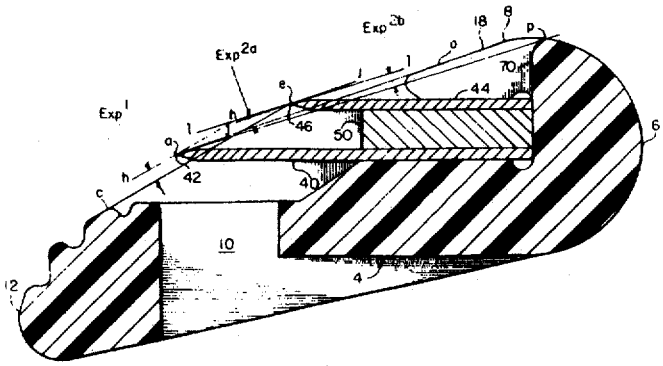

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-6 is confirmed.

* * * * *